US008163042B2

(12) United States Patent
Rao et al.

(10) Patent No.: US 8,163,042 B2
(45) Date of Patent: Apr. 24, 2012

(54) HYDROCARBON FUEL COMPOSITIONS

(75) Inventors: Peddy Venkat Chalapathi Rao, Greater Noida (IN); Sudha Tyagi, Greater Noida (IN); Rajiv Kumar Brahma, Greater Noida (IN); Nettem Venkateswarlu Choudary, Greater Noida (IN); Puthiyaveetil Padmanabhan, Greater Noida (IN); Mohammad Amir Siddiqui, Greater Noida (IN)

(73) Assignee: Bharat Petroleum Corporation Limited, Mumbai (IN)

( * ) Notice: Subject to any disclaimer, the term of this patent is extended or adjusted under 35 U.S.C. 154(b) by 399 days.

(21) Appl. No.: 12/513,025

(22) PCT Filed: Oct. 31, 2007

(86) PCT No.: PCT/IN2007/000517

§ 371 (c)(1),
(2), (4) Date: Jun. 12, 2009

(87) PCT Pub. No.: WO2008/072254

PCT Pub. Date: Jun. 19, 2008

(65) Prior Publication Data

US 2010/0115829 A1 May 13, 2010

(30) Foreign Application Priority Data

Nov. 1, 2006 (IN) ..... 1818/MUM/2006

(51) Int. Cl.
*C10L 1/30* (2006.01)

(52) U.S. Cl. ..... 44/358; 44/361

(58) Field of Classification Search ..... 44/358, 44/361

See application file for complete search history.

(56) References Cited

U.S. PATENT DOCUMENTS

| | | | | |
|---|---|---|---|---|
| 3,591,355 | A | 7/1971 | Kessler | |
| 3,783,841 | A * | 1/1974 | Hirschler et al. | 123/576 |
| 3,989,479 | A | 11/1976 | White | |
| 5,236,467 | A | 8/1993 | Fritz | |
| 5,380,346 | A | 1/1995 | Fritz | |
| 2009/0013589 | A1 * | 1/2009 | Aradi et al. | 44/359 |

FOREIGN PATENT DOCUMENTS

| | | | |
|---|---|---|---|
| CN | 1224049 | A | 7/1999 |
| CN | 1250078 | A | 4/2000 |
| CN | 1253167 | | 5/2000 |
| CN | 1254000 | A | 5/2000 |
| CN | 1297024 | | 5/2001 |
| CN | 1333325 | A | 1/2002 |
| CN | 1366022 | A | 8/2002 |
| EP | 0565715 | A | 10/1993 |
| GB | 813981 | A | 5/1959 |

OTHER PUBLICATIONS

Liu, Q., "Metallic welding-cutting gas is prepared from liquefied petroleum gas . . . ", Database WPI, Jan. 1, 1900, XP002984034.

* cited by examiner

*Primary Examiner* — Cephia D Toomer
(74) *Attorney, Agent, or Firm* — IpHorgan Ltd.

(57) ABSTRACT

The present invention relates to a hydrocarbon fuel composition comprising (i) at least 99% by weight of a base gas; and (ii) additives comprising (a) 2 to 50 ppm organometallic compound; and (b) 100 to 5000 ppm aniline or substituted aniline and 100 to 5000 ppm toluidine. The present invention discloses addition of an additive or additive mixture to base fuel preferably, liquefied petroleum gas. The addition of additive mixture not only improves the properties of the base fuel for use as torch gas for cutting and welding application, but also reduces the consumption of both fuel and oxygen for cutting applications.

15 Claims, 2 Drawing Sheets

HYDROCARBON FUEL COMPOSITIONS

CROSS-REFERENCE TO RELATED APPLICATIONS

This is a National Phase of PCT Patent Application Ser. No. PCT/IN2007/000517, filed on Oct. 31, 2007, (published as WO 2008/072254), which in turn relies for Paris Convention priority on Indian Patent Application No. 1818/MUM/2006, filed on Nov. 1, 2006, both applications being incorporated by reference as if fully set forth herein.

FIELD OF INVENTION

The present invention relates to hydrocarbon fuel compositions comprising base gas for use in cutting and/or welding, high temperature heating gas or oil improved by the addition of additives.

BACKGROUND OF INVENTION

Oxyfuel process is the most applied industrial thermal cutting process for cutting several metals. It can cut thickness from 0.5 mm to 1000 mm or more, the equipment required is low cost and can be used manually or mechanized. Oxyfuel is the mixture of oxygen and a fuel gas such as acetylene, propane, propylene, or natural gas. Oxyfuel process cuts metals by means of the chemical reaction of oxygen with the base metal at elevated temperature. Oxyfuel is used to preheat the metal to its 'ignition' temperature (for steel, it is 700-900° C.) which is well below its melting point. A jet of pure oxygen is then directed into the preheated area initiating a vigorous exothermic chemical reaction between the oxygen and the metal to form metal oxide or slag. The oxygen jet blows away the slag enabling the jet of oxygen to pierce through the material and continue to cut through the material.

Due to its high flame temperature and cutting speed, oxyacetylene flame has long been used for cutting and welding purposes by metal fabricators. Further, acetylene has the highest primary Btu emission and the greatest combustion velocity than commonly available fuel gases. It rapidly heats the base metal up to the kindling point. Other fuel cutting or welding fuel gases are propane, propylene, natural gas, etc. However, the flame temperatures produced by these fuels (in oxygen) are substantially lower compared to acetylene. For example, the maximum flame temperature for propane and natural gas in oxygen is approximately 2810° C. and 2770° C. respectively compared to maximum flame temperature of 3160° C. with acetylene.

The principal torch gas used therefore has been acetylene which is expensive, difficult to store and transport and requires the use of almost pure oxygen for cutting ferrous metals and forms persistently adherent slag. Back firing tendency is another problem often faced while using oxyacetylene flame. As acetylene explodes when subjected to very high pressures, oxyacetylene flame cannot be used under deep water at depths greater than 20 feet under water.

A number of attempts have been made to improve torch gas used in cutting and/or welding torches by adding an additive or additives to them. U.S. Pat. No. 5,236,467 discloses use of methyl ethyl ketone and methyl terbutyl ether in an amount of 0.5% to 13%, preferably 5% to 8% of the base hydrocarbon by weight for use as torch gas. U.S. Pat. No. 3,591,355 proposes the addition of liquid alkanol such as methanol and a mixture of alkanes such as pentane and isopentane, while U.S. Pat. No. 3,989,479 discloses the addition of methanol.

Chinese Patent CN1253167 uses propane, butane & propylene as base gas with combustion aid solution consisting of mixture of $KMnO_4$, $H_2O_2$ and $NaHCO_2$ and containing one oily component which contains 1-3 g ferrocene per 100 ml of gasoline. In another Patent CN 1297024, ferrocene 100-500 g, barium dialkylphenolate (alkylphenolate), iso propane 1-7 L and benzene for preparation of industrial fuel gas have been used for welding applications. British Patent Specification No. 813981 discloses the use of an oxygen containing compound such as isoprypyl ether, methyl isopropyl ether, methyl propyl ether and methanol.

None of the disclosures in the prior art disclose a composition which can result in reduced consumption of fuel or oxygen.

In view of the aforementioned attempts and their limitations the present invention discloses improved hydrocarbon fuel compositions which reduce consumption of expensive fuel or oxygen.

OBJECTS OF THE INVENTION

The primary object of the present invention is to provide an improved hydrocarbon torch gas so as to have characteristics superior to that of acetylene for cutting and/or welding/brazing applications.

Another object of the present invention is to provide a torch gas with high flame temperature to kindle the base metal rapidly.

Yet another object of the present invention is to provide a torch gas for cutting and/or welding applications which can combine effectively with commercial oxygen.

Still another object of the present invention is to provide a torch gas having a base gas which is readily available, economical, safe and a gas which is easy to enchance its attributes as torch gas.

A further object of the present invention is to provide a torch gas enabling ferrous metal to be cut economically, faster, cleaner and safely.

Another object of the present invention is to provide torch gas which can be used by torches for cutting or welding under water at considerable depths.

Yet another object of the present invention is to reduce the consumption of fuel used as torch gas for cutting and/or welding applications.

Still another object of the present invention is to reduce the consumption of oxygen for cutting and welding applications.

SUMMARY OF THE INVENTION

The present invention discloses addition of an additive or additive mixture to base fuel. The addition of additive mixture not only synergistically improves the properties of the base fuel for use as torch gas for cutting and welding application, but also reduces the consumption of both fuel and oxygen for cutting applications.

In an important embodiment, the present invention describes a hydrocarbon fuel composition comprising a synergistic mixture of:

(A) at least 99% by weight of a base gas; and (B) additives comprising (a) 2 to 50 ppm organometallic compound; and (b) (i) 100 to 5000 ppm aniline or substituted aniline and (ii) 100 to 5000 ppm toluidine.

In a preferred embodiment the base gas is liquid petroleum gas.

In still another embodiment of the present invention the organometallic compound is dissolved in a hydrocarbon liquid solvent selected from the group comprising kerosene, gasoline or naphtha.

In still another embodiment of the present invention the aniline or substituted aniline and toluidine is dissolved in oxygen containing organic solvent selected from the group comprising methanol, ethanol, propanol, methyl ethyl ketone, MTBE, or any other suitable compound preferably methanol.

In yet another embodiment the kerosene is boiling in the range of 140-280° C.

In another embodiment the gasoline or naphtha is boiling in the range of 40-140° C.

In a preferred embodiment the organometallic compound is selected from group comprising ferrocene, zirconocene, hafnocene or their derivatives including acetyl ferrocene, propioly ferrocene, butyryl ferrocene, pentanoyl ferrocene, hexanoyl ferrocene, octanoyl ferrocene, benzoyl ferrocene, ethyl ferrocene, propyl ferrocene, n-butyl ferrocene, m-butyl ferrocene, pentyl ferrocene, hexyl ferrocene, cyclopentenyl ferrocene and combinations thereof.

In still another embodiment the aniline or substituted aniline is selected from the group comprising methylaniline, ethylaniline, propylaniline, n-butylaniline and combinations thereof.

In yet another embodiment the toluidine is selected from the group comprising ortho, para, meta-toluidine or combinations thereof.

DESCRIPTION OF THE INVENTION

Figure 1A:
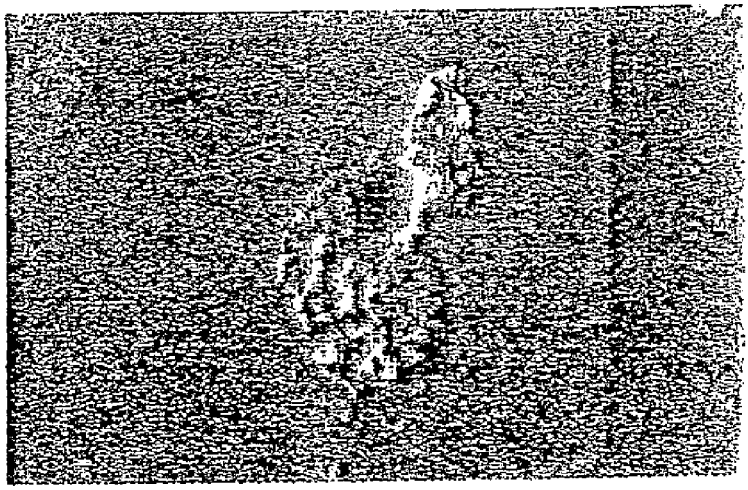
FIG. 1*a*: Hole formation in carbon steel plate using oxy-acetylene.

Liquefied petroleum gas (LPG) is the preferred base gas for the improved torch gas of the present invention. LPG is easily available at a low cost compared to other fuels such as acetylene. LPG is mainly a mixture of C3 and C4 hydrocarbons, (substantially propane and isomers of butane viz., n-butane and i-butane). However, depending on the source of LPG, the same may contain C3 and C4 olefins viz., propylene, 1-butene, 2-butene, i-butylene and butadiene.

Alternatively, the base fuel can be propane or butane alone or a mixture of these gases or propylene, methylacetylene, propadiene, or their mixture, natural gas or other any other suitable hydrocarbon fuel.

It has now been found that addition of an additive mixture to the base fuel not only substantially enhances the flame temperature and improves cutting speed and quality, but also decreases the fuel and oxygen consumption in cutting or welding applications.

The additive is a mixture of Solution-A prepared by dissolving 0.5% to 12% organometallic compound in hydrocarbon liquid solvent such as kerosene, gasoline or any other suitable hydrocarbon liquid solvent and Solution-B prepared by mixing 0.3 to 3 ml aniline or substituted aniline, and 0.3 to 3 ml toluidine in 0.2 to 2 ml oxygen containing organic solvent such as methanol. The organometallic compound is selected from ferrocene, or zirconocene or hafnocence or one or more of their derivatives or mixture thereof. Derivatives of ferrocene which are effective as additive but not limited include, acetyl ferrocene, propioly ferrocene, butyryl ferrocene, pentanoyl ferrocene, hexanoyl ferrocene, octanoyl ferrocene, benzoyl ferrocene, ethyl ferrocene, propyl ferrocene, n-butyl ferrocene, n-butyl ferrocene, pentyl ferrocene, hexyl ferrocene, cyclopentenyl ferrocene, etc. The substituted anilines include alkyl anilines such as methlaniline, ethylaniline, propylaniline, n-butylaniline, etc. Toluidines of the present invention include o-toluidene, m-toluidene, p-toluidene or their mixture. The oxygen containing organic solvent used in the preparation of Solution B described above is selected from methanol, ethanol, propanol, methyl ethyl ketone, MTBE, or any other suitable compound.

The additive mixture may contain 30 to 70% Solution-A, the rest being Solution-B. For every 1 kg of base fuel, e.g. 0.2 ml to 1 ml additives is added to give improved performance in cutting and welding applications.

The additive is liquid at room temperature and hence mixing the additive with the base fuel is simple. First the additive is added to the empty container followed by addition of fuel. For e.g. in case of LPG, additive is added to empty cylinder and subsequently LPG is filled under pressure. Additives can be stored and/or transported safely and easily.

With the improved torch gas of present invention, the cutting speed, kerf formation and surface finish are better than acetylene or base fuel gas. The fuel and oxygen consumption are also lower with the improved torch gas of the present invention. Slag formation is less and no back firing is observed while cutting with improved torch gas of present invention. The other advantage of improved fuel of the present invention over acetylene is that the improved gas of present invention can be used with oxygen of purity as low as 95%. Further, the improved fuel gas composition of the present invention can also be used for cutting applications under water to a depth of about 300 feet acetylene which can only be used under water to depths up to 20 feet.

For metal cutting applications, the consumption of improved torch gas of present invention is 5 to 45% lower compared to acetylene and base LPG depending on the thickness of the plates. The consumption the oxygen is also found to be substantially lower with the improved torch gas of present invention. Oxygen of lower purity can also be employed along with the improved fuel gas of the present invention with out substantially compromising on the quality of cutting.

The present invention is illustrated and supported by the following examples. These are merely representative examples and optimization details and are not intended to restrict the scope of the present invention in any way.

EXAMPLE-1

Additive A is prepared by dissolving 2 g of ferrocene in 100 ml kerosene (boiling range: 140-280° C.) and Additive B is prepared by mixing 40 ml n-methyl aniline, 40 ml mixed toluidine and 20 ml methanol. 1.5 ml each of Additive A and B are added to an empty LPG cylinder and 5 kg of LPG introduced into the cylinder. The cylinder is agitated well to mix the additive with LPG.

The performance of the improved fuel gas composition thus obtained is evaluated by cutting 1 m long, 38 mm thick carbon steel metal plate. For comparison purpose, the metal sheet is also cut using oxy-acetylene and oxy-base LPG. The results thus obtained on the performance of the three gases with respect to time taken for cutting, oxygen and fuel consumption is given in Table 1.

TABLE 1

| Parameter | Oxy-acetylene | Oxy-base LPG | Oxy-improved fuel prepared as described in Example-1 |
|---|---|---|---|
| Time taken for cutting, min. | 6.0 | 5.5 | 5.0 |
| Fuel consumption, g | 139 | 119 | 98 |
| Oxygen consumption, g | 190 | 180 | 135 |

EXAMPLE-2

Additive A is prepared by dissolving 5% wt/vol acetyl ferrocene in gasoline boiling at 40-140° C. and having density of 756 kg/m$^3$. Additive B is prepared by mixing 50 ml methyl aniline, 40 ml mixed toluidine and 40 ml methanol. 1.5 ml each of Additive A and B are added to an empty LPG cylinder and 5 kg of LPG introduced into the cylinder. The cylinder is agitated well to mix the additive with LPG.

Figure 1B:
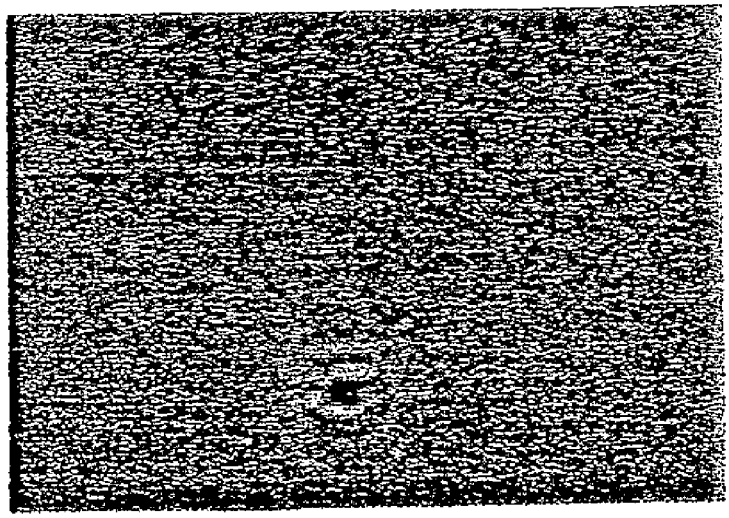
FIG. 1*b*: Hole formation in carbon steel plate using improved fuel of the present invention.

The performance of the improved fuel gas composition thus obtained is evaluated by cutting 1 m long, 90 mm thick carbon steel plate and compared with the results obtained using oxy-base LPG fuel. The result thus obtained on the performance with respect to time taken for cutting and fuel consumption is given in Table 2 and quality of hole formation shown in FIG. 1.

TABLE 2

| Parameter | Oxy-base LPG | Oxy-improved fuel prepared as described in Example-2 |
|---|---|---|
| Time taken for cutting, min. | 7.0 | 5.5 |
| Fuel consumption, g | 183 | 138 |
| Oxygen consumption, g | 455 | 346 |

EXAMPLE-3

Additive A is prepared by dissolving ferrocene in naphtha boiling at 40-120° C. and having density of 705 kg/m$^3$ to obtain a ferrocene solution of 2 wt/vol % and Additive B is prepared by mixing propylaniline, o-toluidine and MTBE in equal proportions. Additive A (2.0 ml) and Additive B (4 ml) are added to an empty LPG cylinder and 5 kg of LPG is introduced into the cylinder. The cylinder is agitated well to mix the additive with LPG.

The performance of the fuel gas composition thus obtained is evaluated by cutting 1 m long, 115 mm carbon steel plate and compared with the results obtained using base LPG fuel. The results thus obtained on the performance with respect to time taken for cutting, fuel and oxygen consumption is given in Table 3.

TABLE 3

| Parameter | Oxy-base LPG | Oxy-improved fuel prepared as described in Example-3 |
|---|---|---|
| Time taken for cutting, min. | 8.5 | 7.0 |
| Fuel consumption, for unit length cut | 224 | 146 |
| Oxygen consumption, g | 670 | 495 |

EXAMPLE-4

Additive A is prepared by dissolving n-butylferrone in kerosene having boiling range of 140-260° C. and density 810 kg/m$^3$ to obtain ferrocene derivative solution of 5% wt/vol and Additive B is prepared by mixing aniline, mixed toluidine and ethyl alcohol in the ratio of 2:2:1. Additive A (1 ml) and Additive B (1.5 ml) are added to an empty LPG cylinder and 5 kg of LPG is introduced into the cylinder. The cylinder is agitated well to mix the additive with LPG.

Figure 2A:
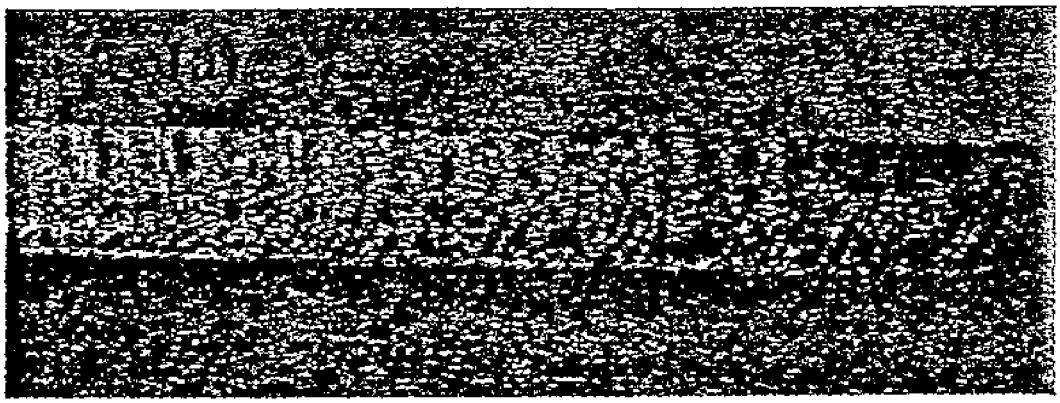
FIG. 2*a*: Kerf formation in carbon steel plate using oxy-acetylene.
Figure 2:
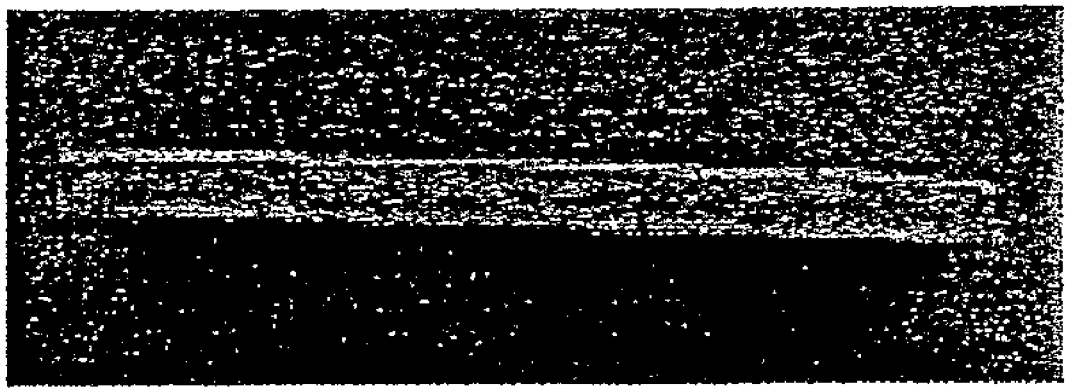
FIG. 2*b*: Kerf formation in carbon steel plate using improved fuel of the present invention.

The performance of the improved fuel gas composition thus obtained is evaluated by cutting 1.5 m, 38 mm thick carbon steel plate and compared with the results obtained using acetylene and base LPG fuels. The results thus obtained on the performance with respect to fuel and oxygen consumption is given in Table 4 and kerf formation is shown in FIG. 2.

TABLE 4

| Parameter | Oxy-acetylene | Oxy-base LPG | Oxy-improved fuel prepared as described in Example-4 |
|---|---|---|---|
| Fuel consumption, for unit length cut | 204 | 176 | 154 |
| Oxygen consumption for unit length cut | 288 | 266 | 226 |

EXAMPLE-5

Additive A is prepared by dissolving ethylferrocene in gasoline having boiling range 40-140° C. and density 756 kg/m$^3$ to obtain ethylferrocene solution of 3wt/vol % and Additive B is prepared by mixing ethylaniline, p-toluidine and ethyl alcohol in the ratio of 2:2:1. Additive A (1.5 ml) and Additive B (2.0 ml) are added to an empty LPG cylinder and 5 kg of LPG is introduced into the cylinder. The cylinder is agitated well to mix the additive with LPG.

The performance of the improved fuel gas composition thus obtained is evaluated by cutting 1 m long, 115 mm thick carbon steel metal plate and compared with the results obtained using base LPG fuel. The results thus obtained on the performance with respect to fuel and oxygen consumption is given in Table 5.

TABLE 5

| Parameter | Oxy-base LPG | Oxy-improved fuel prepared as described in Example-5 |
|---|---|---|
| Fuel consumption, g | 224 | 162 |
| Oxygen consumption, g | 670 | 504 |

EXAMPLE-6

Additive A is prepared by dissolving zirconocene in kerosene having boiling range 140-260° C. and density 810 kg/m$^3$ to obtain zirconocene solution of 3 wt/vol % and Additive B is prepared by mixing methyl ethyl ketone, p-toluidine and methyl alcohol in the ratio of 2:2:1. Additive A (1.5 ml) and Additive B (2.0 ml) are added to an empty LPG cylinder and 5 kg of LPG is introduced into the cylinder. The cylinder is agitated well to mix the additive with LPG.

The performance of the improved fuel gas composition thus obtained is evaluated by cutting 1.5 m long, 90 mm thick carbon steel metal plate and compared with the results obtained using base LPG fuel. The results thus obtained on the performance with respect to fuel and oxygen consumption is given in Table 6.

TABLE 6

| Parameter | Oxy-base LPG | Oxy-improved fuel prepared as described in Example-6 |
|---|---|---|
| Fuel consumption, g | 183 | 168 |
| Oxygen consumption, g | 455 | 412 |

The main advantages of the present invention are:

1. The hydrocarbon fuel composition of the present invention has a better cutting speed, kerf formation and surface finish than acetylene or base fuel gas.
2. The fuel and oxygen consumption are also lower with the improved fuel gas of the present invention.
3. Slag formation is less and no back firing is observed while cutting with improved fuel gas of present invention.
4. The hydrocarbon fuel gas composition of the present invention can also be used for cutting applications under water to a depth of about 300 feet.
5. For metal cutting applications, the consumption of hydrocarbon fuel gas composition of the present invention is 5 to 45% lower compared to acetylene and base LPG depending on the thickness of the plates.
6. The consumption the oxygen is also substantially lower with the hydrocarbon fuel gas composition of the present invention.
7. Oxygen of lower purity can also be employed along with hydrocarbon fuel gas composition of the present invention without substantially compromising on the quality of cutting.

We claim:

1. A hydrocarbon fuel composition comprising a synergistic mixture of:

(A) at least 99% by weight of a base liquefied petroleum gas (LPG); and (B) additives including (a) 2 to 50 ppm organometallic compound, wherein said organometallic compound is selected from the group consisting of ferrocene, zirconocene, hafnocene, and ferrocene derivatives including acetyl ferrocene, proployl ferrocene, butyryl ferrocene, pentanoyl ferrocene, hexanoyl ferrocene, octanoyl ferrocene, benzoyl ferrocene, ethyl ferrocene, propyl ferrocene, n-butyl ferrocene, m-butyl ferrocene, pentyl ferrocene, hexyl ferrocene, cyclopentenyl ferrocene and combinations thereof; and (b) (i) 100 to 5000 ppm aniline or substituted aniline and (ii) 100 to 5000 ppm toluidine.

2. The hydrocarbon fuel composition as claimed in claim 1 wherein said organometallic compound is dissolved in a hydrocarbon liquid solvent selected from the group comprising kerosene, gasoline or naphtha.

3. The hydrocarbon fuel composition as claimed in claim 2 wherein said kerosene has a boiling range of 140°-280° C.

4. The hydrocarbon fuel composition as claimed in claim 2 wherein said gasoline or naptha has a boiling range of 40°-140° C.

5. The hydrocarbon fuel composition as claimed in claim 1 wherein said aniline or substituted aniline and toluidine is dissolved in an oxygen containing organic solvent.

6. The hydrocarbon fuel composition as claimed in claim 5 wherein said oxygen containing organic solvent is selected from the group consisting of methanol, ethanol, propanol, methyl ethyl ketone, MTBE, and combinations thereof.

7. The hydrocarbon fuel composition as claimed in claim 1 wherein said aniline or substituted aniline is selected from the group comprising methylaniline, ethylaniline, propylaniline, n-butylaniline and combinations thereof.

8. The hydrocarbon fuel composition as claimed in claim 1 wherein said toluidine is selected from the group comprising ortho, para, meta-toluidine or combinations thereof.

9. A hydrocarbon fuel composition comprising a synergistic mixture of:

(A) at least 99% by weight of a base liquefied petroleum gas (LPG); and (B) additives including (a) 2 to 50 ppm organometallic compound, wherein said organometallic compound is selected from the group consisting of ferrocene, zirconocene, hafnocene, and ferrocene derivatives including acetyl ferrocene, propioyl ferrocene, butyryl ferrocene, pentanoyl ferrocene, hexanoyl ferrocene, octanoyl ferrocene, benzoyl ferrocene, ethyl ferrocene, propyl ferrocene, n-butyl ferrocene, m-butyl ferrocene, pentyl ferrocene, hexyl ferrocene, cyclopentenyl ferrocene and combinations thereof; and (b) 100 to 5000 ppm toluidine.

10. The hydrocarbon fuel composition as claimed in claim 9 wherein said organometallic compound is dissolved in a hydrocarbon liquid solvent selected from the group comprising kerosene, gasoline or naphtha.

11. The hydrocarbon fuel composition as claimed in claim 10 wherein said kerosene has a boiling range of 140°-280° C.

12. The hydrocarbon fuel composition as claimed in claim 10 wherein said gasoline or naptha has a boiling range of 40°-140° C.

13. The hydrocarbon fuel composition as claimed in claim 9 wherein said toluidine is dissolved in an oxygen containing organic solvent.

14. The hydrocarbon fuel composition as claimed in claim 13 wherein said oxygen containing organic solvent is selected from the group consisting of methanol, ethanol, propanol, methyl ethyl ketone, MTBE, and combinations thereof.

15. The hydrocarbon fuel composition as claimed in claim 9 wherein said toluidine is selected from the group comprising ortho, para, meta-toluidine or combinations thereof.

* * * * *